US005127894A

United States Patent [19]

Maccaferri

[11] Patent Number: 5,127,894

[45] Date of Patent: Jul. 7, 1992

[54] DEVICE FOR MAKING CARTONS FROM FLATTENED TUBULAR BLANKS

[75] Inventor: Luciano Maccaferri, Bologna, Italy

[73] Assignee: I.M.A. Industria Macchine Automatiche S.p.A., Ozzano Emilia, Italy

[21] Appl. No.: 707,572

[22] Filed: May 30, 1991

[30] Foreign Application Priority Data

Jun. 7, 1990 [IT] Italy ..... 3542 A/90

[51] Int. Cl.[5] ..... B31B 1/78; B31B 1/80

[52] U.S. Cl. ..... 493/316; 493/319; 53/566

[58] Field of Search ..... 493/316, 317, 318, 319; 53/566

[56] References Cited

U.S. PATENT DOCUMENTS

| | | | |
|---|---|---|---|
| 3,293,998 | 12/1966 | Farnow | 493/316 |
| 3,533,334 | 10/1970 | Schuster | 493/316 |
| 3,534,667 | 10/1970 | Krause | 493/316 |
| 3,682,052 | 8/1972 | Vuilleumier et al. | 493/319 |
| 3,888,164 | 6/1975 | Taddei | 493/319 |
| 4,066,009 | 1/1978 | Calvert et al. | 493/316 |
| 4,531,931 | 7/1985 | Dietrich | 493/317 |
| 4,596,544 | 6/1986 | Hull | 493/319 |
| 5,027,586 | 7/1991 | Ramaker | 493/316 |

*Primary Examiner*—William E. Terrell
*Attorney, Agent, or Firm*—Darby & Darby

[57] ABSTRACT

A device for the transformation of a flattened tubular blank into a carton includes a pickup unit for withdrawing a tubular blank from a magazine, wherein the blanks are arranged, flat, in a pile, and an angle plate for opening a selected blank into shape of a carton, while transferring the blank to a station, where the carton is placed on a step-driven conveyor running along a packaging line. A pusher, actuated synchronously with the pickup unit and the conveyor, keeps the carton on the conveyor during an initial forward motion.

8 Claims, 4 Drawing Sheets

DEVICE FOR MAKING CARTONS FROM FLATTENED TUBULAR BLANKS

BACKGROUND OF THE INVENTION

The present invention concerns the technical art dealing with the packaging of articles in cartons formed from tubular blanks supplied flat.

More specifically, the invention concerns a device to transform these tubular blanks into corresponding cartons.

DESCRIPTION OF THE PRIOR ART

Automatic machines of various types used for packaging articles already exist, operating according to different techniques, known to technicians in the art.

This machinery generally includes a packaging line, along which the cartons obtained from the flattened tubular blank are conveyed in steps; these blanks are taken from a special magazine in which they are arranged flat in piles.

Therefore, such packaging machinery usually includes devices designed to transform the tubular blanks into corresponding cartons.

For example, a known device of this type includes means to pick up the tubular blanks, such means consisting of a blade which moves transversely to the magazine, so that it slides, into the bottom blank in the pile; this blade also operates vertically to convey the blank it has picked up to the packaging line.

During transfer, appropriate guides cause the tubular blank to be opened into the required shape, to form a carton.

The open cartons are then transported along the line by step-driven conveying means to a packaging station.

In the machinery of this kind, the cartons need to be kept so that the cross section of their open end is exactly right during transport to allow the articles to be inserted correctly.

To make the best use of the volume of the cartons, and consequently save space, the cartons must be only slightly larger than the articles to be packaged.

This requirement is particularly important in packaging equipment which operates at high speed to achieve a high rate of production, such as packaging lines for blister packs and similar items.

In this case, the conveying means of the packaging line should be equipped with a means for holding the cartons.

However the stress to which the cartons are subjected, especially during the initial forward movement, can easily cause the cartons to shift away from the correct transport position.

SUMMARY OF THE INVENTION

The object of the this invention is to provide a device to transform a flattened tubular blank into a carton, while maintaining the exact shape of the carton after that this carton has been formed.

Another object of this invention is to provide a device which is not only technically simple, but also functional, reliable and versatile in application.

These objects are achieved by a device for transforming a flattened tubular blank picked up from a magazine, where the blanks are arranged flat in piles, the device comprising means for opening the blank into the form of a carton, during the transfer of the blank to a feed station where the carton is placed on a stepdriven conveyor running in a packaging line.

The device also includes a pusher, operated at the feed station synchronously with a pickup unit and the conveyor, in order to keep the carton on the conveyor during the initial forward movement.

BRIEF DESCRIPTION OF THE DRAWINGS

The characteristics of the invention which do not appear from the above description are stated below, with reference to the appended drawings, in which.

DESCRIPTION OF THE PREFERRED EMBODIMENT

Figure 1:
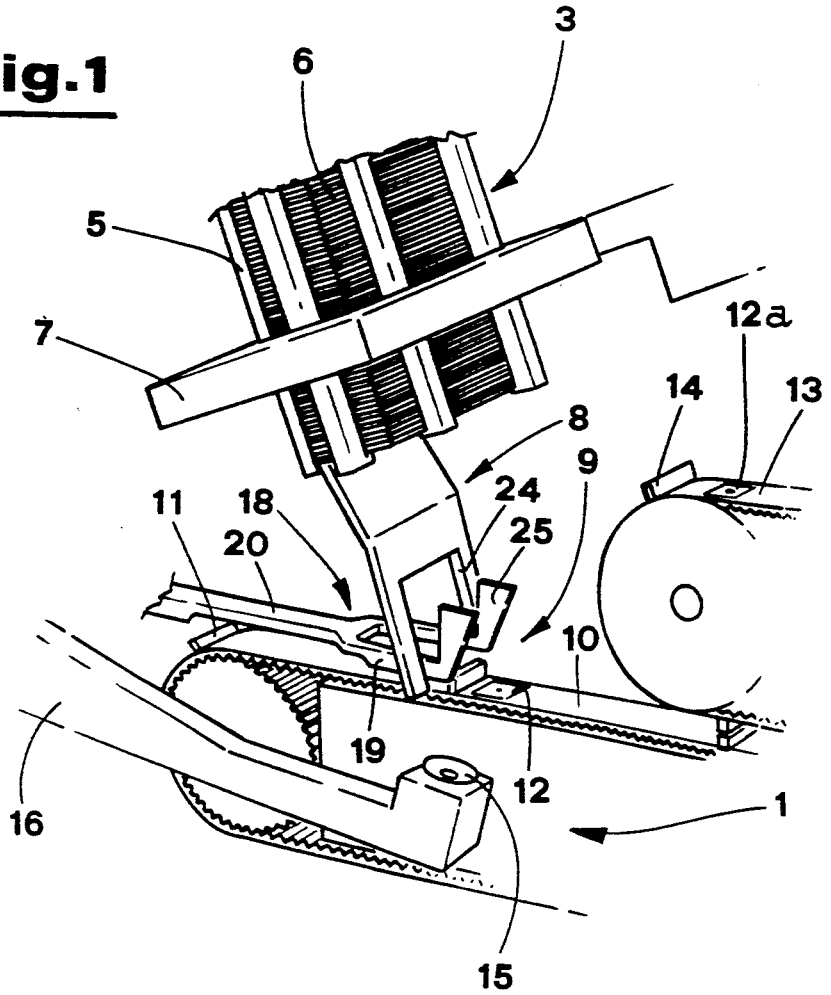
FIG. 1 illustrates a perspective view of the device concerned.

With reference to the aforesaid figures, 1 indicates broadly a pickup unit designed to withdraw a tubular blank 2 from a magazine 3, in which these blanks 2 are arranged flat in piles.

The magazine 3 is located at the start of a packaging line 4 and includes a number of guides 5, between which the pile of blanks, referred to as 6 for clarity, is situated; the guides 5, supported by a framework 7, are fitted with special support bodies for the lower edges of the pile 6.

Below the magazine 3, there are means 8 to open the blank 2 into the shape of a carton; these means 8 basically consist of an angle plate, designed to act as a fixed guide for the blank 2 during the transfer of the blank 2 itself to a feed station 9.

At the feed station 9 the carton 2*a* is placed on a step-driven conveyor 10 running along a packaging line 4.

The conveyor 10 comprises a belt with crosspieces 11, regularly spaced, acting as supports for the cartons. The conveyor belt 10 also has holes 12, adjacent to the crosspieces 11, through which the upper part of the belt communicates with conventional suction devices, not shown in the drawing; the vacuum produced by these suction devices serves to keep the cartons on the conveyor belt 10.

Following feed station 9, the packaging line 4 includes other conveying means 13, longitudinally aligned above the conveyor belt 10; these conveying means 13 also consist of a belt fitted with regularly spaced crosspieces 14, to work together with the conveyor belt 10.

The conveyor belt 13 also has holes 12*a* adjacent to the crosspieces 14, through which the lower part of the belt communicates with the suction means.

The pickup unit 1 includes a pair of suction lift cups 15, fitted onto respective arms 16 arranged symmetrically at the sides of the conveyor belt 10.

The arms 16 are actuated so as to rotate about a transverse shaft 17 so as to provide the reciprocating motion of the suction lift cups 15 between a raised position below the magazine 3 and a lowered position at the level of the upper part of the conveyor belt 10.

At the feed station 9 there is a pusher 18 that is designed to operate on the carton on the conveyor belt 10.

The pusher 18 comprises a fork 19 at the end of a rod 20 which is actuated synchronously with the pickup unit 1 and with the conveyors 10 and 13, by reciprocating means 21 formed by a pair of arms 22 swivelling on respective pivots 23, constituting an articulated parallelogram.

The fork 19 passes through a hole 24 in the lower part of the plate 8 which opens the blank 2.

The tooth-like projections of the fork 19 are also fitted with heads 25, by means of which the pushing means 18 operate on the carton. It should be noted that the front edge of each head 25 is forward slanting so that the carton is forced down slightly while it is being pushed forward.

The operation of the device to transform the flattened tubular blanks 2 into corresponding cartons is described below with particular reference to FIGS. 3 to 7, illustrating successive operating stages.

Figure 3:
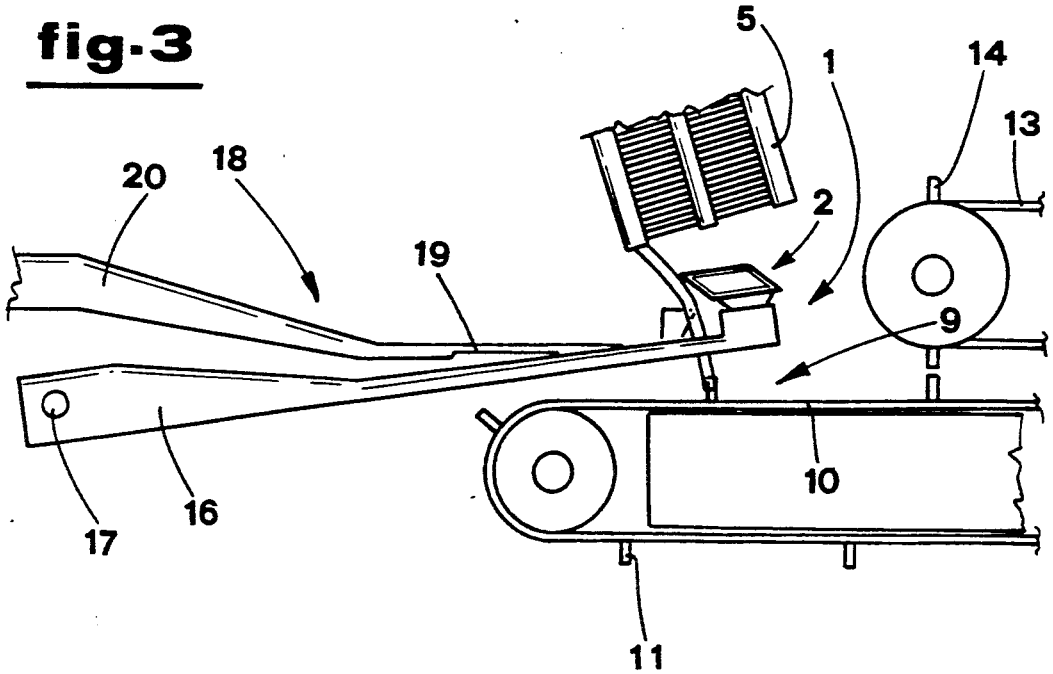
FIGS. 3, 4, 5, 6 and 7 illustrate subsequent stages in the operation of the device.

The pickup unit 1 by means of the suction cups 15 draws the blank 2, located at the bottom of a pile 6 housed in the magazine 3; the blank is held by the suction cups 15 and transferred towards the feed station 9 (FIG. 3).

Figure 4:
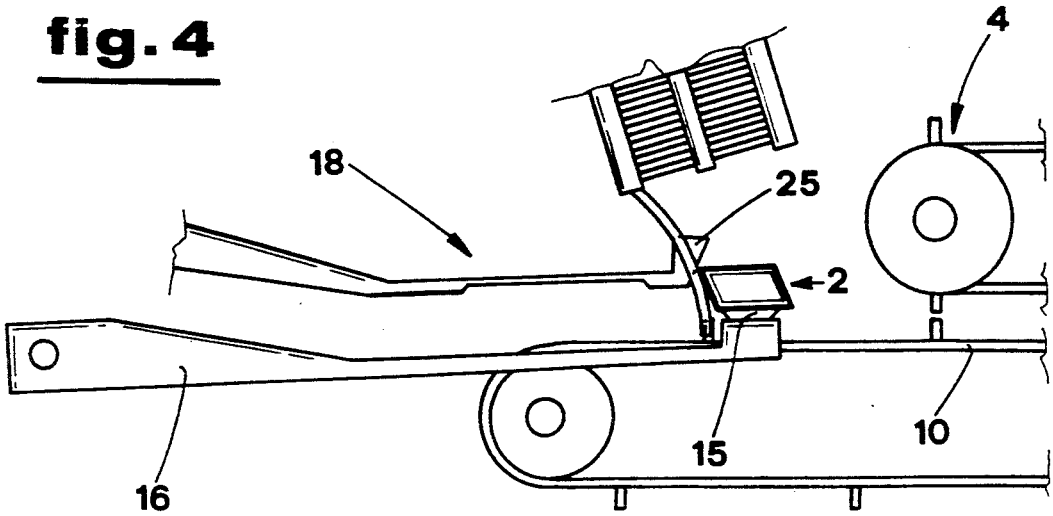

During this transfer stage, the blank 2 comes into contact with the fixed guide consisting of the opening plate 8 and is forced to open into its tubular form, according to the folding lines made during manufacture of the blank (FIG. 4).

After the blank 2 has been picked up and during its transfer to the feed station 9, the conveyor belts 10, 13 of the packaging line 4 are stationary; in fact the forward movement of the conveyor belts 10, 13 alternates with the shaping stages of the cartons.

Figure 2:
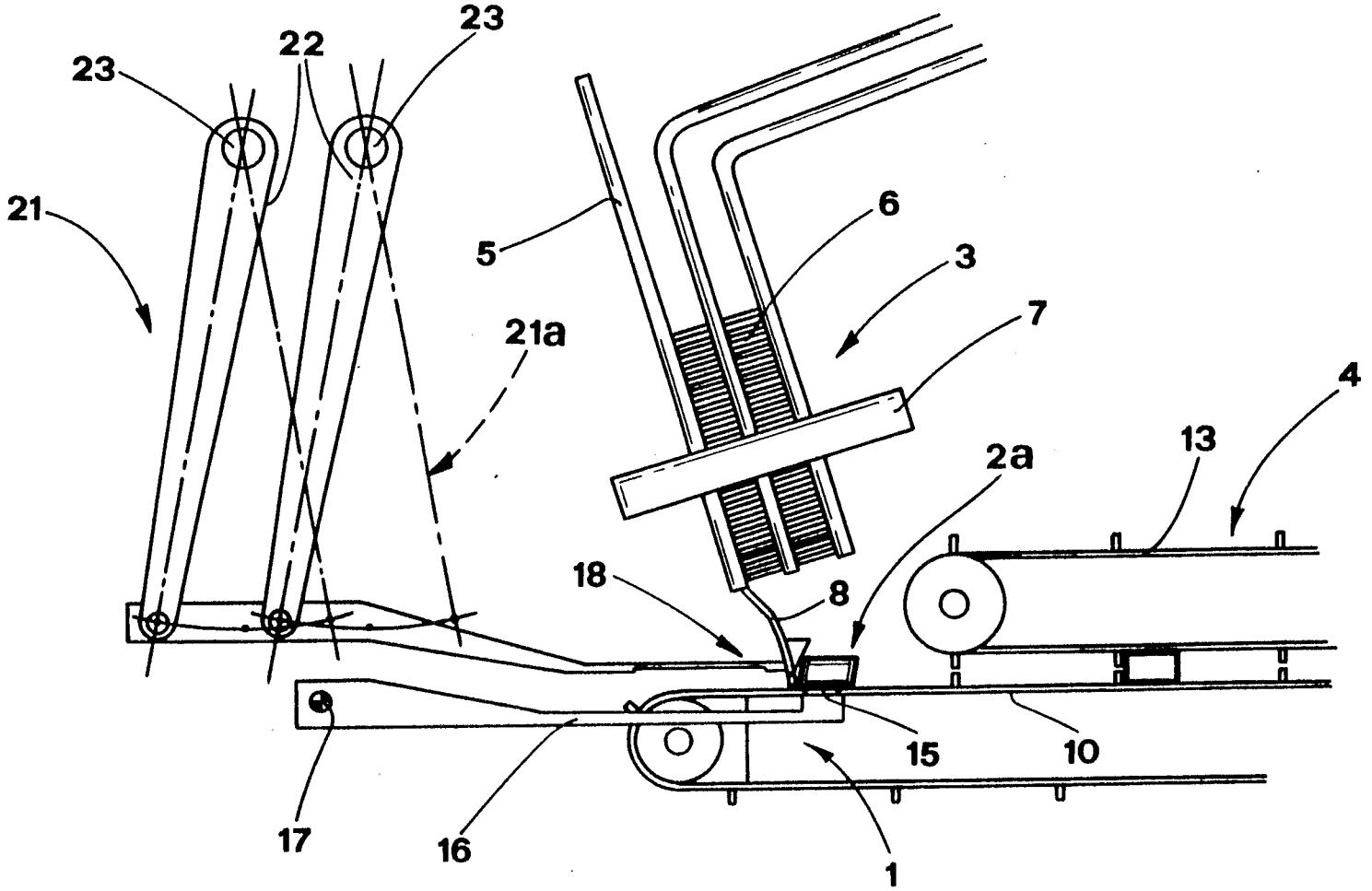
FIG. 2 illustrates a side view of a packaging line equipped with the device concerned.

The open carton, referred to as 2*a*, is placed on the conveyor belt 10 next to a crosspiece 11, as shown in FIG. 2; in this position the carton can be held by the suction created by the vacuum through the hole 12.

Then the conveyor belts 10, 13 are driven forward synchronously in such a way as to hold the carton between them.

At the same time, the pusher 18 is moved synchronously, touching the side of the carton 2*a* with the heads 25, above crosspiece 11.

Figure 5:
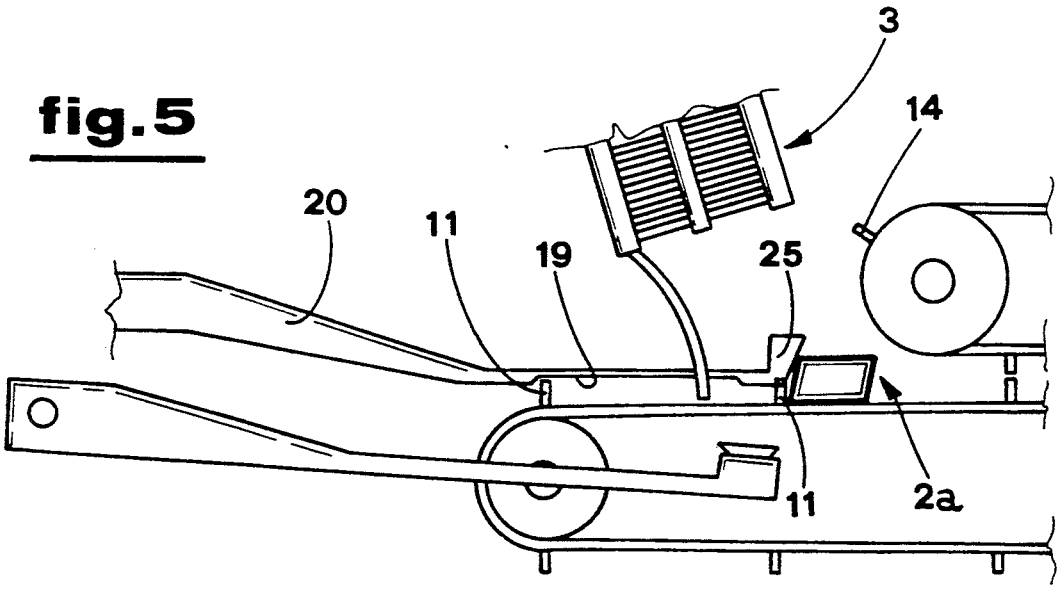

The pusher 18 moves parallel to the upper part of the belt 10, because of the movement of the reciprocating means 21 towards the forward position 21*a*, thus accompanying the forward movement of the carton 2*a* along the belt 10 (FIG. 5).

A very important feature of the pusher 18, is constituted by the fact that the front edges of the heads 25 have a forward slant so that the pushing action is directed downwards.

This lowering action of the pushing force is applied to the carton 2*a* in order to hold the carton on the conveyor belt 10, during its initial forward movement.

Figure 6:
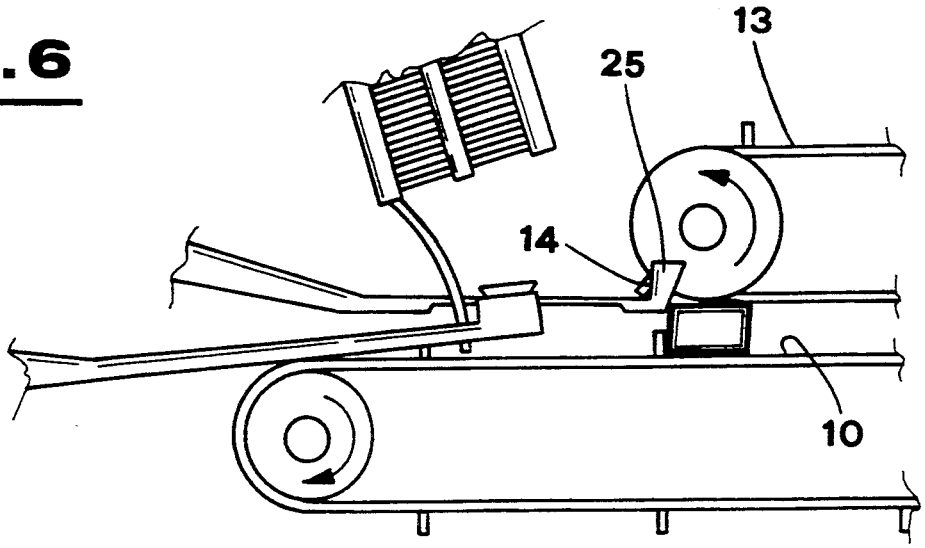

The carton is therefore unable to move out of the correct transporting position and maintains its exact open shape, that is to say with right angles, since the pusher 18 moves forward to guide the carton 2*a* up to the infeed area between the counter-rotating conveyor belts 10 and 13 (FIG. 6).

The spacing between belts 10 and 13 is more or less equal to the height of the carton.

Figure 7:
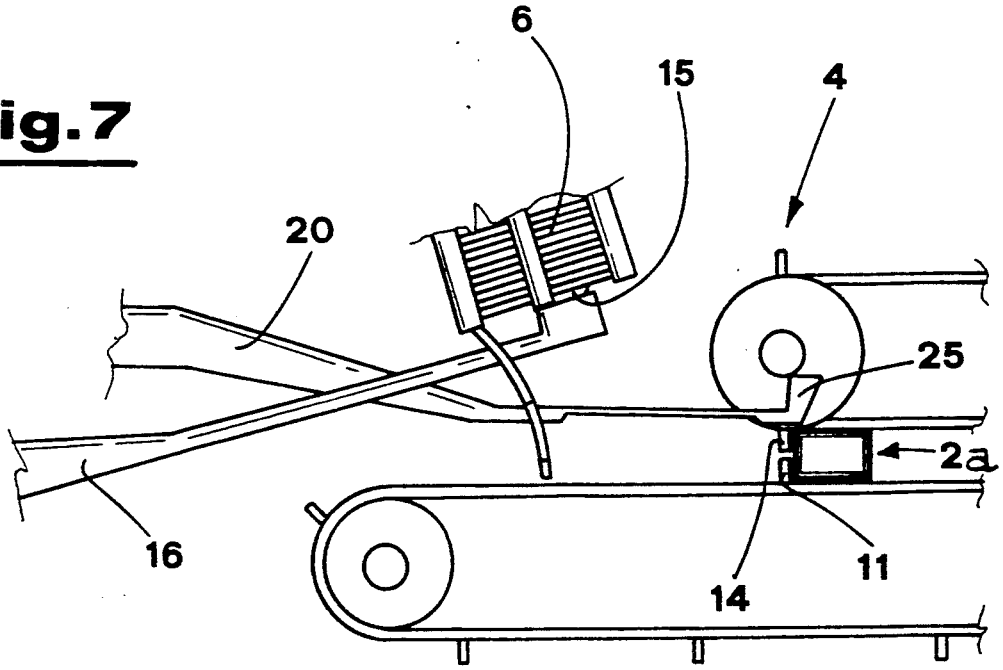

In this area a crosspiece 14 of the belt 13 is placed over crosspiece 11 of the belt 10, its action replacing that of the heads 25 (FIG. 7).

At the same time the next blank is picked up from the magazine 3.

In conclusion, the device described in the present invention enables a flattened tubular blank to be transformed into a corresponding carton, while maintaining the carton in the exact open shape, even during the subsequent transfer to the packaging station.

In fact after insertion between the conveyor belts 10 and 13, the carton is held in position by the vacuum through the holes 12, 12*a* which works in conjunction with the elastic lifting action of the belts 10, 13. In this way it is impossible for the cartons transported to move sideways, even at high working speed.

In particular, this enables high operating speeds to be attained, giving high productivity in packaging lines for articles in blister packs or similar items.

These articles are usually supplied in piles, so the open side of the carton has to be perfectly aligned with the pile on reaching the packaging station, to enable correct insertion into the pile itself.

The opposite side of the carton is closed during transport to the packaging station.

Although the invention has been described in connection with specific embodiments thereof, changes and modifications may be made therein without departing from the scope of the appended claims.

What is claimed is:

1. A device for making a carton from a flattened tubular blank comprising:

a first conveyor defining a packaging line;

a magazine located at the beginning of said packaging line for holding a plurality of tubular blanks in a flat pile, pickup means to withdraw a tubular blank from said magazine and deposit it on said first conveyor;

an angle plate between said magazines and said first conveyor means acting as a fixed guide for opening said blank into shape of a carton during a transfer stage of said blank to said first conveyor;

pusher means actuated in synchronism with said pickup unit and said conveyor and having at least one head with a forward slanting front edge to engage said carton so as to push downward and hold the carton on said first conveyor during an initial forward motion;

reciprocating means to move said pusher means in synchronism with the operation of said pickup unit and conveyor; and a further conveyor longitudinally aligned above said first conveyor to assist the transport of said carton along said packaging line with said carton being guided by said pusher means while moving along said first conveyor and toward said further conveyor.

2. A device according to claim 1, wherein said pusher means includes a rod having a fork at one end facing the direction of movement of said first conveyor, said fork having on its end at least one said head for engaging said carton.

3. A device according to claim 1, wherein said first conveyor has holes communicating with suction sources to provide a suction force to hold said carton thereon during an initial forward motion of said first conveyor.

4. A device according to claim 1, wherein said further conveyor has holes communicating with a suction source to provide a suction force to hold said carton located between said first conveyor and further conveyor.

5. A devices as in claim 1 wherein said pickup means comprises an arm having a suction means at one end thereof, means for swinging said arm between a first position at which the suction means engages a tubular blank in said magazine and a second position at which the carton is placed on said first conveyor.

6. A device as in claim 4 wherein said arm is located outside of and along one side of said first conveyor.

7. A device as in claim 6 wherein said pusher means comprises a second arm having a suction means at an end thereof on the other side of said first conveyor.

8. A device as in claim 1 wherein said reciprocating means comprises a pair of first arms each having one end rotating on a respective pivot forming an articulated parallelogram for moving said pusher means.

* * * * *